US005675951A

United States Patent [19]

Gow

[11] Patent Number: 5,675,951

[45] Date of Patent: Oct. 14, 1997

[54] BAMBOO WORKPIECE, MOLDING AND TRIM AND METHOD FOR MAKING

[76] Inventor: Robert H. Gow, 4707 Pin Oak Park #544, Houston, Tex. 77081-2251

[21] Appl. No.: 541,243

[22] Filed: Oct. 12, 1995

[51] Int. Cl.[6] ..... B04F 13/00

[52] U.S. Cl. ..... 52/287.1; 52/311.3; 52/730.1; 428/537.1; 144/333

[58] Field of Search ..... 52/288.1, 287.1, 52/730.1, 211, 311.3, 311.2; 428/106, 537.1, 703, 17; 144/333, 332, 350

[56] References Cited

U.S. PATENT DOCUMENTS

| | | | |
|---|---|---|---|
| D. 243,887 | 3/1977 | Levin et al. | D8/351 |
| 721,231 | 2/1903 | Plue | 52/656.4 X |
| 1,645,812 | 10/1927 | Lane | 144/333 |
| 2,256,946 | 9/1941 | Hill | 428/537.1 X |
| 4,184,404 | 1/1980 | Tomioka | 428/537.1 X |
| 4,473,605 | 9/1984 | Rausch | 428/17 |
| 4,774,906 | 10/1988 | Lu | 118/404 |
| 4,810,551 | 3/1989 | Chu | 428/537.1 X |
| 4,968,549 | 11/1990 | Smimizu et al. | 428/537.1 X |
| 5,135,597 | 8/1992 | Barker | 428/537.1 X |
| 5,271,996 | 12/1993 | Tanabe et al. | 428/537.1 X |
| 5,505,238 | 4/1996 | Fujii et al. | 428/107 X |

OTHER PUBLICATIONS

J.A. Youngquist, "Laminated Wood-Based composites", pp. 1-41.

*Primary Examiner*—Carl D. Friedman
*Assistant Examiner*—Winnie Yip
*Attorney, Agent, or Firm*—Hutcheson & Grundy, L.L.P.

[57] ABSTRACT

Bamboo molding or trim is provided from the interior of bamboo culms. The bamboo is divided into pieces which may be laminated to form workpieces from which the molding or trim is formed. Selected cross-sections, spindles and other forms are provided. The bamboo may be treated for resistance to decay or to increase dimensional stability.

3 Claims, 3 Drawing Sheets

BAMBOO WORKPIECE, MOLDING AND TRIM AND METHOD FOR MAKING

BACKGROUND OF THE INVENTION

This invention pertains to articles such as moldings, trim and the like. More particularly, bamboo molding or trim and glued bamboo workpiece are provided.

Wood and synthetic materials are commonly used for trim and molding materials. Frames, such as those used to surround artworks, photographs and various decorative objects, are often made from wood. The wood may be stained, painted, or otherwise coated. Decoration of buildings on flat surfaces and at corners or other highly visible locations is often provided by wood or synthetic materials shaped into selected cross-sections. Spindles and other elongated decorative pieces are often produced from wood. The wood is preferably of a variety which is easily machined or worked.

Such decorative pieces are often made from a square or rectangular cross-section workpiece, such as a 1"×1½" member which is several feet in length. Such workpiece may be fed into a molder, such as the Wadkin Spindle Molder or the Mattison Electric Molder. The molder is set to cut the starting material into a desired cross-section. Elongated pieces may also be turned on a lathe to produce spindles and the like. Trims and molding may be formed from a variety of woodworking tools.

Gluing wood pieces together to form laminated wood-based composites has long been practiced. Plywood is formed by a cross-banded construction, where two or more layers of wood are joined with an adhesive so that the grains of the layers are not parallel. Glued-laminated materials for construction are made by parallel grain construction, as distinguished from the cross-banded construction of plywood, and are often referred to as "glulam." The size, shape and thickness of laminations and the uses of such materials may vary greatly.

The art of producing laminated structural components from wood is well developed. The strength of the product depends on the quality of the glued joints. The laminating process requires special equipment not needed to produce solid lumber. Laminated wood has been used for furniture parts, cores of veneered panels, sporing goods, structural members and other applications. Softwoods, principally Douglas Fir and Southern Pine, are most commonly used for laminated timbers, but other soft woods are used, according to the Kirk-Othmer *Encyclopedia of Chemical Technology*, 3rd Edition, Volume 14, "Laminated Wood-based Composites," pages 1–41. Applications of such materials usually take advantage of their increased strength or their deformability into arches and curved surfaces.

Bamboo is widely grown in tropical areas of the world. It exists in a number of varieties. The structure of bamboo is strikingly different from that of many other plants. The trunk of the plant is called the "culm." "Nodes" exist at various distances along the culm. The culm is hollow inside except where nodes exist. Some varieties, such as Dendrocalamus Strictus, Guadua, Jimba, or Cana Bravo, produce culms having thicker walls.

The physical properties of bamboo are somewhat unique also. Bamboo is stronger than most wood which is used to make trim or moldings. Bamboo is also more flexible and elastic. When flexed, it bends slightly and will not break as easily as wood. When flexed or deformed for a short period of time, it will return to its original configuration. Bamboo is also easily treatable with chemicals. Some methods can be used on bamboo which make it easier to treat than wood, because the fibers in bamboo run in the same direction. For example, a treatment method for bamboo is the Boucherie/Sap Displacement method.

Once established, bamboo replenishes itself very fast. Therefore, fully developed bamboo culms can be cut every two to three years. Hardwoods or softwoods may take 20 or more years to grow and when cut must be started again from small trees. Bamboo can be planted along permanent roads. Therefore, it can be transported easily to a factory. A very large volume of bamboo timber can be produced on small acreage, and bamboo responds economically to fertilizer and irrigation.

Bamboo can easily be split with a star splitter or other tools. A culm can be split into multiple pieces by this multi-bladed instrument as it is driven into the end of the bamboo culm. The split proceeds along the fibers, which are in the longitudinal direction. Therefore, the rip sawing down the length of a log to make lumber is not necessary to make smaller pieces of bamboo. A disadvantage of bamboo in some application may be the growth habit of not producing straight culms. Bamboo culms often grow in arcs as outer culms reach for sunlight.

U.S. Pat. No. 4,810,551 discloses a bamboo board. The board comprises a number of longitudinal layers and lateral layers made by bamboo strips bonded together with adhesives. The longitudinal layers and lateral layers are laid over alternatively, with strips of each layer at right angles to those of adjacent layers. It is suggested that the bamboo board can be used to replace natural wood boards and manufactured wood boards.

While a variety of materials have been suggested and utilized for trim and molding, the unique properties of bamboo, such as the fact that all the fibers run in the same (longitudinal) direction, the ease of splitting, laminating and working have not been realized in such articles. Workpieces of bamboo, bamboo trim and molding and methods of making such articles are needed.

SUMMARY OF THE INVENTION

Molding or trim of bamboo is provided from a piece of a bamboo culm within the outer skin of the culm. A selected cross-section is formed transverse to the fibers of the bamboo. In another embodiment, the bamboo contains a glue joint between separate pieces of bamboo.

A workpiece for molding or trim is provided from glued pieces of bamboo culm. The pieces of bamboo culm may have all plane surfaces or they may have a curved surface in a plane transverse to the fibers of the bamboo.

A method for forming a bamboo molding or trim is provided. The culms are split or otherwise divided into pieces and the outer surface of the bamboo is removed. In one embodiment, multiple pieces are glued with fibers substantially parallel to form a workpiece of bamboo. The pieces may have a plane surface or a curved surface in a plane transverse to the fibers of the bamboo pieces. The bamboo piece or workpiece is then formed into a selected cross-section.

BRIEF DESCRIPTION OF THE DRAWINGS

FIG. 2(*b*) shows the planes or cuts to be made in one of the segments to form rectangular cross-section pieces which may be used to form a glued laminate workpiece.

DETAILED DESCRIPTION OF PREFERRED EMBODIMENT

Figure 1:
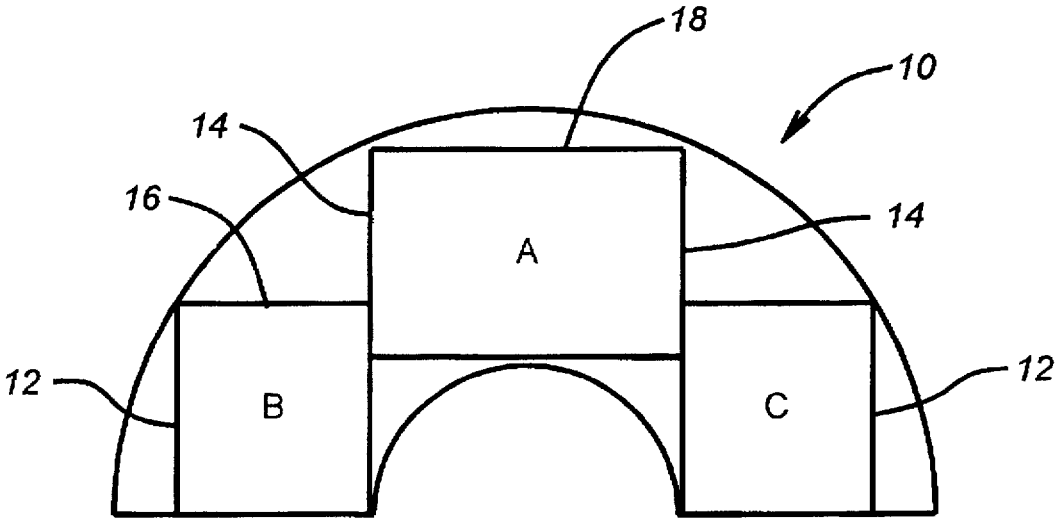
FIG. 1 shows a pattern of cuts in half of a bamboo culm to form rectangular cross-section pieces which can be used to form a glued laminate workpiece.

Referring to FIG. 1, half a bamboo culm 10, formed by splitting a whole culm, is to be cut to form rectangular pieces A, B and C. For a culm having a diameter of about 4 inches, the dimensions of A are about ½ inch by 1 inch and the dimensions of square cross-sections B and C are about 1 inch. The cuts may be made by laying the flat side of half bamboo culm 10 on the table of a band or disc table saw and cutting each side of the culm at surface 12. The pieces may then be rotated 90° so that recently sawed side 12 is against the table and surface 18 formed. Surfaces 14 may then be formed and the remaining plane surfaces formed on pieces A, B and C. The sizes of pieces A, B and C depend on the diameter and wall thickness of the culm. If pieces B and C are ½ inch square, three may be glued together in one direction with two layers to make a 1½ inch×1 inch workpiece, for example. The pieces are glued together to form a bamboo workpiece using techniques well known in industry for producing laminate wood products. The same type glues as used in other laminated products may be used. The glue is normally cured by heat, applied as the pieces are pressed together.

Figure 2A:
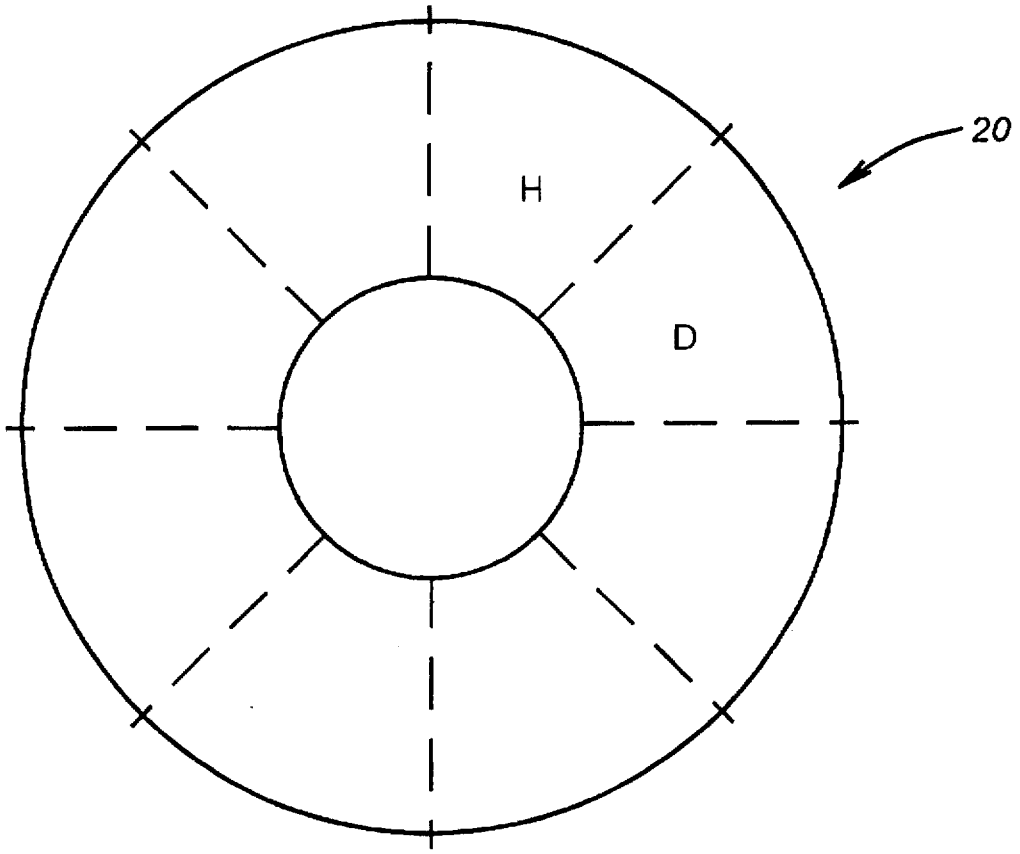
FIG. 2(*a*) shows a bamboo culm split into segments.
Figure 2B:
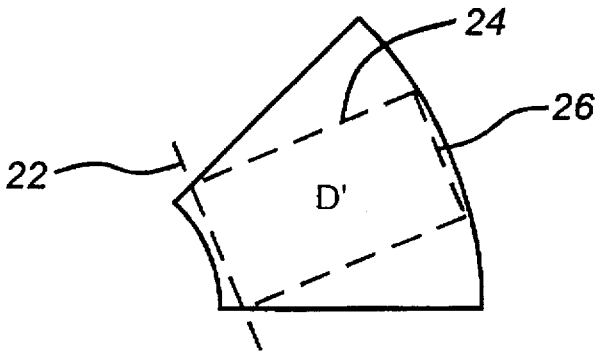

Referring to FIG. 2(*a*), bamboo culm 20 is split into eight segments as shown, including segments D and H. The splitting may be accomplished with a star splitter, a well-known tool for splitting bamboo. The number of segments formed is selected to have pieces of the dimensions needed for the workpiece, molding or trim to be formed. Segments have two curved surfaces and two plane surfaces, the plane surfaces being along the radii of the original culm. The curved surface of the inside of the culm is easily formed into a plane by sanding or other abrasive means to form plane surface 22, as shown in FIG. 2(*b*). Then, on that plane surface 22, the segment is fed into a molder to make a rectangular, square (not shown) or trapezoidal (not shown) cross-section piece (D'). Alternatively, a rectangular cross-section is formed by cutting at surfaces 24 and 26. Pieces having various combinations of cross-section may then be glued to form a bamboo workpiece.

For thick-walled bamboo culms which are straight, the bamboo may initially be cut by lathe, blade or other wood-working tool, or abraded to remove the outer skin of the culm and to form a plane surface along one side of the culm. The remaining culm, having a flat side, may then be fed into a shaper or molder to form molding or trim having a selected cross-section. In the operation of most molding machines, it is advantageous to have a flat side when the work piece is fed into the machine. Alternatively, a shaper is modified to cut a flat side with the first cutter and then the entire culm may go into the shaper to form bamboo molding or trim. This procedure is particularly appropriate when a molding or trim is to be made having an extended rounded surface, so as to fit inside a right-angle intersection of walls, for example.

Figure 3:
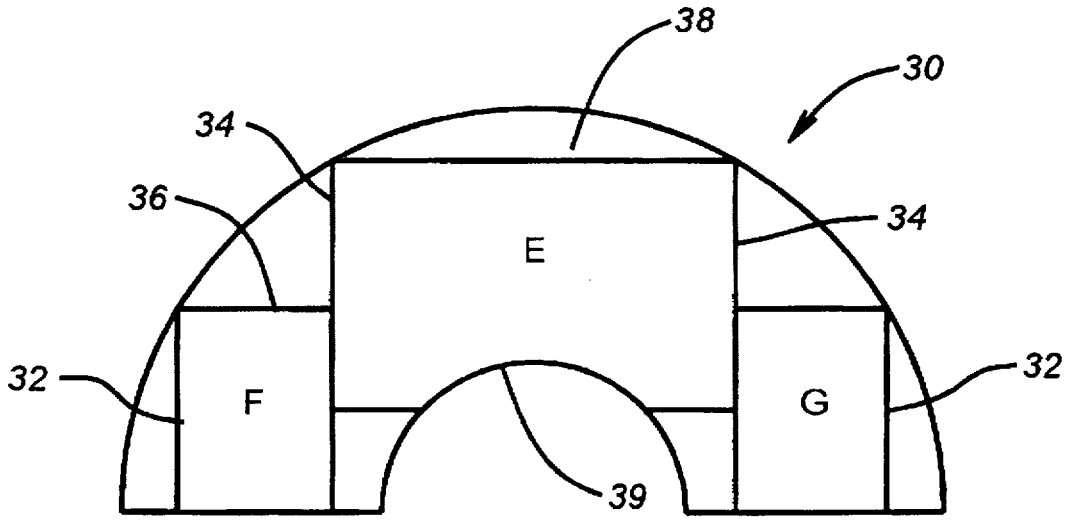
FIG. 3 shows a pattern of cuts in a bamboo culm to form pieces, one piece having a curved surface, the pieces to be used in a glued laminate workpiece.

In another embodiment, pieces of bamboo are formed in which the interior surface of a bamboo culm remains in the natural, curved form. Such cross-section is illustrated in FIG. 3. Such half culm 30 may be cut at surfaces 32 and 38 to form flat surfaces on each side of the culm. Surfaces 34 are then cut, but the distance between such surfaces is selected such that curved surface 39 remains. Surfaces 36 are then formed.

Figure 4A:
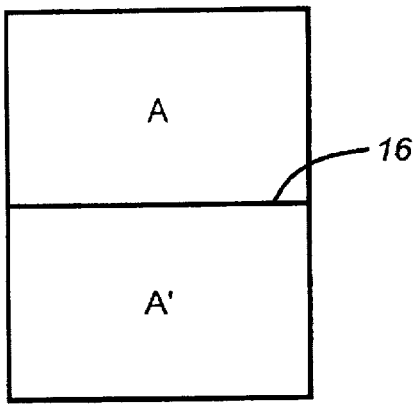
FIG. 4 shows cross-sections of workpieces of glued laminate bamboo.
Figure 4B:
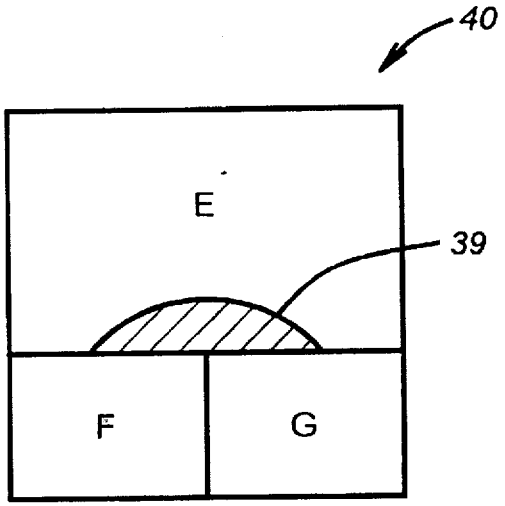

Some examples of cross-sections of workpieces of bamboo are shown in FIG. 4. Workpieces are formed by gluing together the pieces formed by cutting or abrading, as described above. If a bamboo culm is split into four quarters, it will best be split so that one quarter is the outside area of a bend and a second quarter is the inside arc of the bend. Once split, these two pieces can be straightened relatively easy. The side pieces are more difficult to straighten. However, use of bamboo in glued laminates allows the opportunity to utilize even the sections of culms which are not straight—by straightening the pieces before gluing. Pieces curved in opposite directions may be placed in contact and glued such that the curvature of separate pieces is in different directions and the composite is straight, or the pieces may simply be glued while in a straight configuration. In another embodiment, the bamboo pieces are heated or otherwise treated to allow the pieces to conform to a desired configuration before glue is applied to the pieces to form the laminate.

In some applications, workpiece or molding of bamboo may be desired in a curvilinear configuration. Bamboo is particularly suitable for such applications, in that the uniform direction of fibers and the flexibility of bamboo pieces transverse to the longitudinal direction give bamboo pieces the ability to bend in a short radius without splitting. Also, use of bamboo in many moldings and trims allows support by a substrate to maintain permanently a desired direction of the molding or trim, even in a curved configuration, if desired. The lamination of separate bamboo pieces allows formation of laminates in a desired curvilinear configuration, even in ornate patterns having short radii of curvature in the configuration.

A rectangular laminated bamboo workpiece formed from pieces such as "A" of FIG. 1 is shown in FIG. 4(*a*). The workpiece has glued surface 16. The individual pieces of the workpiece may be straightened after the glue is applied and before curing. The pieces may be rectangular, trapezoidal, or other shapes having plane surfaces. The pieces may be glued together such that voids may exist between the pieces having plane surfaces.

In FIG. 4(*b*), the cross-section of a work piece 40 formed by laminating pieces E, F and G of FIG. 3 is shown. A void in the crosssection is formed contiguous to curved surface 39.

A variety of sizes of bamboo culm will normally be used to make the laminated material. In FIG. 1, if bamboo culm of a size that will produce 1-inch by 1½-inch pieces "A" is used, 1-foot of workpiece such as shown in FIG. 4 (*a*) and 1-foot of 2-inch square workpiece is produced per foot of bamboo culm. By using the method of splitting the bamboo into segments, as illustrated in FIG. 2, assuming culms 2 inch in diameter and having a normal wall thickness of ⅝ inch, at least 8 pieces of ⅜ inch×½ inch bamboo can be produced. Four pieces laminated in the ⅜ inch direction produce 1½ inch. Two pieces in the ½ inch direction produce 1 inch. Thus, 8 pieces form a cross-section 1"×1½". By this procedure, again one foot of culm produces 1 foot of workpiece that may be used to produce molding or trim.

Molding workpiece may be produced in a selected cross-section. A workpiece such as shown in FIG. 4(*a*) may be used to form picture molding, for example. In FIG. 4(*b*), bamboo pieces indicated in FIG. 3 have been glued to form a cross-section of a workpiece having an internal void. Such pieces are then laminated such that the hollow region exists inside the laminate. The advantage of such construction is that larger pieces of bamboo can be cut with three planed sides to produce the laminate. This allows lower cost production of laminate from the same culms of bamboo. For selected cross-sections of the molding and trim of this invention, such construction is allowed, since the cross-section of the molding would be selected such that the void interior of the composite is not penetrated.

Such workpieces may be formed into a spindle having square and round segments, as normally produced using wood as a raw material, for example. It has been found that bamboo pieces can be turned on a lathe to produce such articles. Many shapes of bamboo trim and molding may be produced from bamboo pieces and workpieces, and it should be understood that such is true of each workpiece described herein.

Figure 5A:
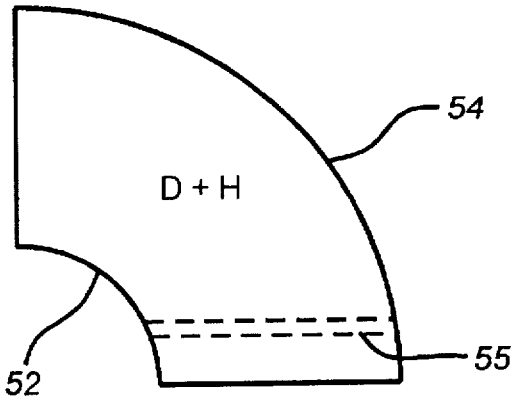
FIG. 5 shows cross-sections of molding and trim made of bamboo.
Figure 5B:
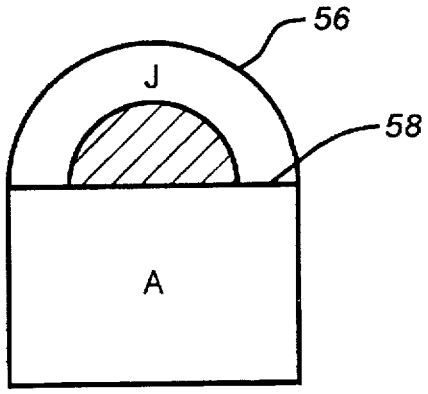
Figure 5C:
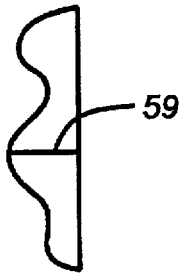

In FIG. 5(*a*), "quarter-round" trim of bamboo is shown. Such trim may be formed by splitting a bamboo culm as shown in FIG. 2, except that only four segments are formed instead of fight. The quarter-round piece is then made up of segments D and H of FIG. 2 (*a*) . Inside surface 52 of the culm may be left unfinished or as it is found in the culm. Outside surface 54 may be formed by splitting off a layer of the bamboo using a circular blade or by turning the bamboo culm in a lathe prior to splitting. The surface may then be abraded to form smooth surface 54. Alternatively, surface 54 may be formed by simply abrading off the outside surface of the culm. Hole 55 may be pre-drilled through the trim to allow a fastener such as a nail to be used without risk of splitting the bamboo trim.

In FIG. 5(*b*), curved surface 56 of a bamboo culm has been formed by splitting and abrading or by abrading, as described above. Piece "J" is formed from half a bamboo culm or less than a half to have a width equal to the width of piece A. Piece J and piece A are then joined by gluing at surface 58, leaving a void within the molding. Many combinations of rounded exterior bamboo culms and rectangular cross-section laminate may be produced. All such materials may have pre-drilled holes.

FIG. 5(*c*) shows the cross-section of a molding as, for example, to be used in a picture frame or for wall decoration, which has been formed, for example, by a molding, shaping or routing machine from a bamboo workpiece such as shown in FIG. 4(*a*). Glued surface 59 joins separate pieces of bamboo culm which were laminated to form the workpiece from which the molding was formed. It should be understood that many cross-sections and combinations of molding or trims may be formed, and FIG. 5 illustrates only three of such cross-sections.

Cross-sections of workpieces and molding or trim have been discussed heretofore. It should be understood that pieces of bamboo formed into cross-sections as discussed herein or in other cross-sections may be placed in layers having overlapping pieces and glued such that the cross-section can be extended to any desired length. All pieces of bamboo would have fibers in substantially the same direction. The cross-section of such multilay and overlapping workpiece or molding may be shaped or formed as previously described.

Bamboo used in workpieces or molding of this invention may be treated by a variety of treatments for fire or decay resistance, dimensional stability, hardness and special decorative effects. Such treatments are well known for application to wood.

Other variations and embodiments of the invention will be recognized by one skilled in the art, and it is intended that the invention be limited only as set forth within the claims appended hereto.

What is claimed is:

1. A molding or trim, comprising:

a plurality of pieces of bamboo, each piece having fibers in substantially a longitudinal direction; and a glued joint disposed between the pieces of bamboo, the pieces having substantially parallel fibers, wherein the pieces of bamboo are disposed to form a void between two of the pieces of bamboo, the two pieces of bamboo having a longitudinal surface in the direction of the fibers.

2. The molding or trim of claim 1 wherein the longitudinal surface of one of the pieces of bamboo is curved in a plane transverse to the longitudinal surface of the piece of bamboo, the surface being contiguous to the void in the molding or trim.

3. A workpiece to be used to form a trim or molding comprising:

a plurality of pieces of bamboo, each piece having fibers in a longitudinal direction and a selected cross-section; and a glued joint disposed between the pieces of bamboo, the pieces having substantially parallel fibers, wherein the pieces of bamboo are disposed to form a void therebetween.

* * * * *